United States Patent [19]

Sterling

[11] 4,103,781

[45] Aug. 1, 1978

[54] PORTABLE ADJUSTABLE CLOTHES DRYING DEVICE

[75] Inventor: John R. Sterling, Crystal Lake, Ill.

[73] Assignee: John Sterling Corporation, Richmond, Ill.

[21] Appl. No.: 827,554

[22] Filed: Aug. 25, 1977

[51] Int. Cl.[2] ..... A47F 5/00

[52] U.S. Cl. ..... 211/86; 211/123; 403/112

[58] Field of Search ..... 211/86, 87, 105.1, 105.6, 211/123; 248/59, 204, 298, 218.4, 410, 414, 351, 354, 355, 356; 403/112

[56] References Cited

U.S. PATENT DOCUMENTS

| | | | |
|---|---|---|---|
| 1,798,568 | 3/1931 | Wagenhorst | 403/112 X |
| 3,019,909 | 2/1962 | Churchill | 211/86 |
| 3,025,969 | 3/1962 | Daley | 211/86 |
| 3,043,438 | 7/1962 | Chmielewski | 211/123 X |
| 3,163,295 | 12/1964 | Standard | 211/86 |
| 3,466,032 | 9/1969 | Thornton | 403/112 X |
| 3,494,583 | 2/1970 | Parr | 248/218.4 |

FOREIGN PATENT DOCUMENTS

| | | | |
|---|---|---|---|
| 748,729 | 12/1966 | Canada | 211/86 |

*Primary Examiner*—Roy D. Frazier
*Assistant Examiner*—Terrell P. Lewis
*Attorney, Agent, or Firm*—McCaleb, Lucas & Brugman

[57] ABSTRACT

A portable, lightweight clothes drying rack, adapted to be erected over a shower stall or bathtub enclosure to extend between a shower curtain rod and an opposing vertical enclosure wall; the device comprising a rigid, unitary member having a linear portion which is operationally supported near one end by the shower curtain rod and is formed with an upturned portion at its opposite end which is engageable with the enclosure wall at an elevation above the shower curtain rod. A stop means, adjustably movable along the member to accommodate variations in the shower curtain rod to wall distance, also serves to couple the linear portion to the curtain rod and stabilize the device in operating position.

1 Claim, 6 Drawing Figures

PORTABLE ADJUSTABLE CLOTHES DRYING DEVICE

BACKGROUND OF THE INVENTION

1. Field of the Invention

The invention relates to portable clothes drying racks and devices, and more particularly to drying racks of the type that can be erected over a bathtub or shower stall.

2. Description of the Prior Art

Many clothes drying racks have been available in the past, but only a few have been directed to solving the problem of conveniently hanging wet clothes, such as lingerie, light towels, synthetic blouses, etc., over a bathtub or shower stall for drying. Such devices need, of course, to be portable, readily mountable in a drying position, easy to take down, lightweight, formed of reasonably long-lasting materials, and inexpensive.

Among known prior art drying racks is one which comprises two substantially straight threadingly interconnected hollow tube members, one of which is axially adjustable relative to one another, and one of which has a hook member at its outer end adapted to fit over a shower curtain rod. The two members are threadingly extendible until a desired operating length is reached so that one end thereof may hook over the shower rod while the opposite end abuts an opposing wall of the tub or shower stall enclosure. A significant problem encountered with this particular prior art device is that it is geometrically unstable under load. Thus, in order to maintain the device between the shower rod and wall, it must be erected on a slight pitch to the horizontal; i.e., the end abutting the tub enclosure wall must be placed higher than the end hooked over the shower curtain rod to insure that the weight of the wet clothes hanging therefrom does not overcome the frictional engagement of the one bar end with the enclosure wall and cause the clothes and rack to fall. Such an inclined operating position, however, renders the device unacceptable because clothes suspended on wire clothes hangers or the like tend to slide toward the lower end of the bar, while clothes merely draped thereover shift and slide in a similar manner.

Another known device of the prior art employs a three-piece triangular structure in which the hypotonuse member extends angularly between the enclosure wall and the shower curtain rod, while the article supporting base member is adjustable through cooperating pin and slot connections with the hypotonuse member to achieve a horizontal position and accommodate differing distances between the shower curtain rod and an opposing support wall. Because of its limited positions of adjustment, this device is difficult to install and is not dependably secure when erected.

SUMMARY OF THE INVENTION

The present invention is directed to a unitary, portable, adjustable, lightweight clothes drying rack that is easily and quickly installed in a horizontal supporting position between a shower curtain rod and one wall of a bathtub or shower enclosure. The device comprises a rigid, unitary member having a linear body formed with an upturned portion at one end which is covered by a grip cap for frictional connection with an opposing wall of the tub or shower enclosure. The opposite end portion of the body operationally extends past and is supported by the shower curtain rod and a stop member is adjustable along the full length of the body to accommodate variations in the shower rod to enclosure wall dimension. The stop member also engages the shower curtain rod to secure one end of the device thereto in operating position, whereat the linear body is horizontal for supporting articles and the upturned end is elevated thereover and frictionally engages an opposing wall of the tub or shower enclosure.

Once the device is erected in its operating position, individual articles of clothing and wire hangers hung thereon tend to remain in position without sliding toward either end thereof. Further, because of the geometrically stable erected state of the drying device, due to the combined effect of the upturned end portion thereof and the connective stop member, there is little or no tendency for the rod to rock or fall, even under loaded conditions.

Accordingly, it is one of the objects of the present invention to provide a lightweight, portable, inexpensive and easily erected support means for drying articles.

It is a further object of this invention to provide a clothes drying rack that is stable in a substantially horizontal operating position.

It is still another object of this invention to provide a unitary supporting device for drying clothes which is erectable between a shower curtain rod and a vertical wall and which incorporates improved means for adjusting the same to accommodate varying distances between such rod and the wall.

Having described this invention, illustrative means by which the foregoing and other objects and features of the present invention are accomplished will be readily understood from the following description of a preferred embodiment thereof illustrated in the accompanying drawings, in which.

DESCRIPTION OF THE PREFERRED EMBODIMENT

Figure 1:
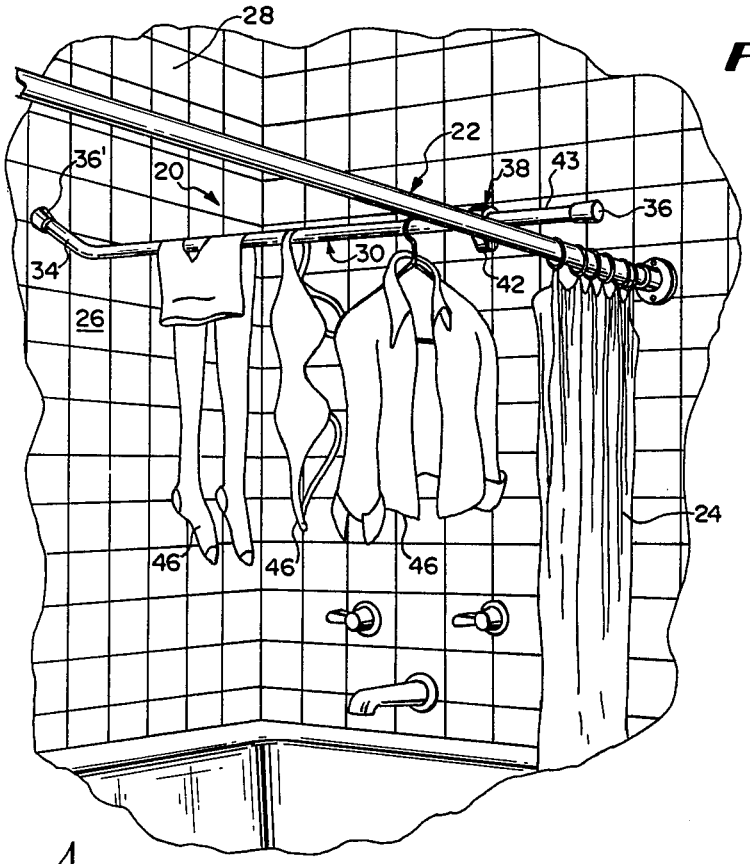
FIG. 1 is a perspective showing of the clothes drying rack of the present invention and its operational environment.

Referring to the drawings, wherein like reference numerals indicate corresponding elements and parts, a portable clothes drying rack or device according to this invention and generally denoted by reference number 20 in FIG. 1, is shown in a substantially horizontal operating position between a horizontal rod 22 used to support a shower curtain 24 and a back wall 26 of a bathtub or shower enclosure. It will be understood that assembly 20 can be utilized with other types of shower door or shower curtain support members such as, for example, a horizontal metal sliding door header (not shown), which is typically used to aesthetically cover the guide track upon which a shower door is supported. It also will be understood that instead of the enclosure wall 26 comprising ceramic tile 28, as shown in FIG. 1, the herein disclosed drying rack 20 is equally useful with other type surfaces.

Figure 2:
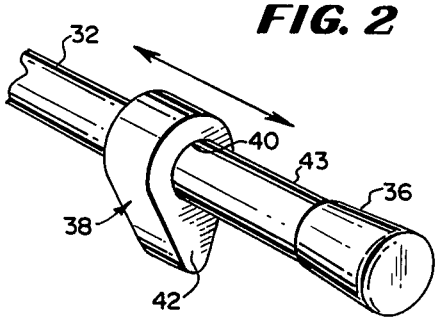
FIG. 2 is a perspective view of one end portion of the rack of FIG. 1.
Figure 3:
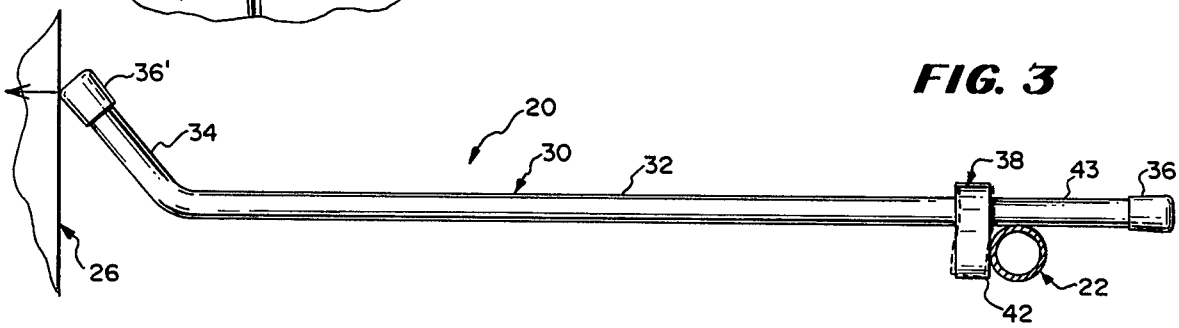
FIG. 3 is a side elevational of the rack, depicted in its erected position and showing certain associated elements in section.
Figure 4:
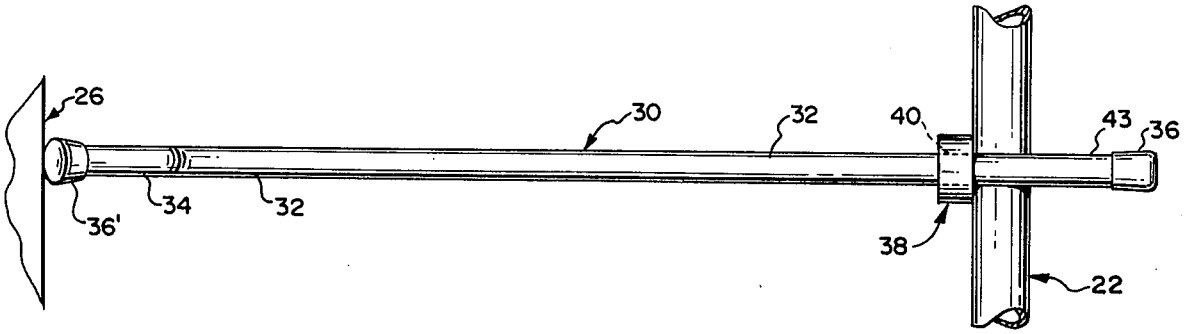
FIG. 4 is a plan view of the rack in erected position.

As depicted in FIGS. 3 and 4, assembly 20 comprises an elongated lightweight unitary rigid member 30 (shown herein as tubular), having a linear body portion 32 and an upturned portion 34 at one end thereof. The outer ends of member 30 preferably are covered by protective end cap members 36, 36'. A stop member 38 having a central opening 40 is mounted on the body portion 32 for adjustable movement therealong. The particular stop member 38 illustrated in FIGS. 2–4 is generally triangular shaped to incorporate a depending lobe portion 42 which, as will be explained in greater detail presently, is operable to engage and frictionally couple one end of member 30 to the shower curtain rod 22 or other horizontal support member. As shown in FIG. 2, the stop member 38 is capable of being slidably adjusted along body portion 32 in either direction so as to be placed in selected operating positions thereon whereby to accommodate various distances between the curtain rod 22 and support wall 26.

The end caps 36, 36' and stop member 38 preferably are formed of a reasonably long-lasting, resilient material, for example, natural or synthetic rubbers, or other elastomeric materials, such as vinyl plastic. In this manner the end cap 36' will frictionally engage, but not mar the back wall 26 when the drying rod 20 is erected thereagainst. Also, with stop member 38 made of resilient material, it will firmly frictionally grip body portion 32 to maintain its adjusted position therealong, as well as couple member 30 to the shower rod 22.

Figure 5:
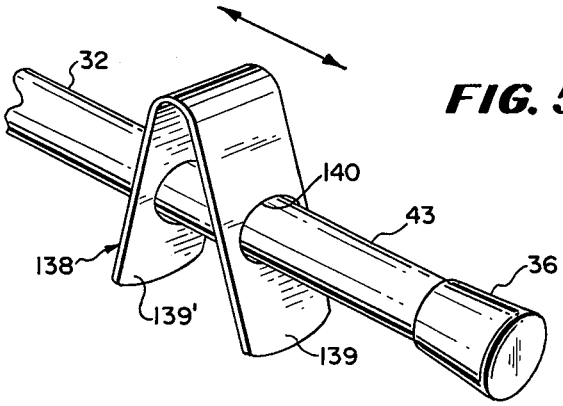
FIG. 5 is a perspective view, similar to FIG. 2, illustrating one end portion of a modified drying rack.
Figure 6:
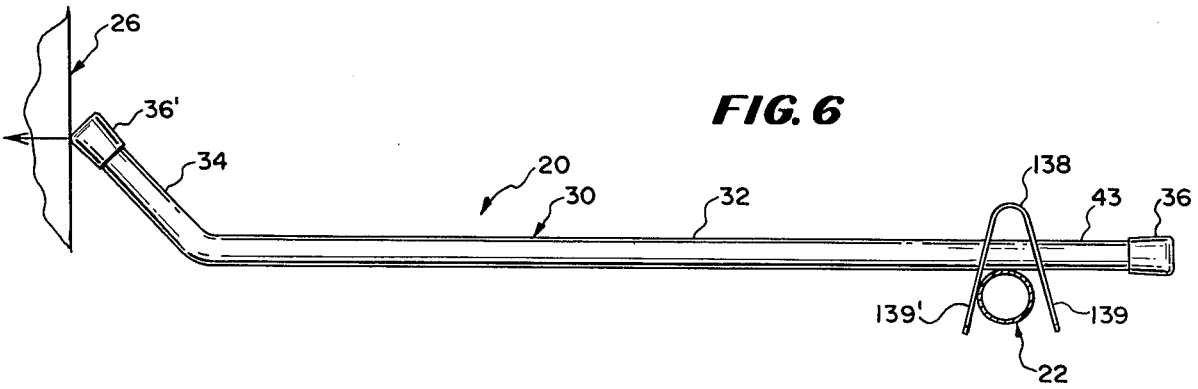
FIG. 6 is a side elevational view, similar to FIG. 3, showing the modified rack of FIG. 5 in erected position.

It is to be noted that while the resilient stop member 38, as herein described, provides a convenient and simple friction-lock system, it is fully contemplated that the same may be rigid and include any of various known means or devices for positively locking the same at selected positions along member 30, as desired. By way of example, FIGS. 5 and 6 illustrate a modified assembly in which an alternate form of stop member 138 is employed, the remainder of the assembly being as above described. It will be recognized that stop member 138 comprises a spring metal or other resilient material member bent in substantial V-shape to comprise a pair of divergently related arms 139, 139', each having an opening 140 therethrough of slightly greater diameter than rigid member 30. The linear portion 32 of the member 30 freely passes through the two openings 140 when the arms 139, 139' are biased toward parallel positions. On the other hand, when the arms 139, 139' are spread to divergent relation, as shown in FIGS. 5 and 6, the perimeters of openings 140 bind against the exterior of portion 32 to hold the stop member in a desired position.

The drying member 30 advantageously is made of a lightweight, rigid non-corrosive material, such as aluminum or chrome plated or stainless steel. Further, the same may be either solid or tubular and have cross-sectional configurations other than the cylindrical form illustrated.

Turning now to the erection and operation of the clothes drying rack 20, FIGS. 1, 3 and 4 illustrate how the unitary member 30 is mounted between the enclosure back wall 26 and the shower curtain rod 22. As shown, the outer end section 43 of portion 32 overlies and is supported on top of shower curtain rod 22 while the end cap 36' at the outer end of the angularly disposed upturned end portion 34 abuts wall 26 at a point or elevation which is substantially above the level of end section 43 and the shower curtain rod 22. The stop member 38 is initially located on the body portion 32 to lie between the shower curtain rod and enclosure wall 26. When the rack or device 20 is properly positioned with its body portion 32 horizontal, the stop member 38 is then moved along the body portion 32 until it firmly abuts and flexibly engages the shower curtain rod 22 (see dotted lines in FIG. 3). Because of the slight interference fit between opening 40 of the illustrated stop member 38 and body portion 32 and the fact that member 38 is formed of a resilient friction-productive material, the stop member 38 tightly grips body portion 32, as well as the periphery of the shower curtain rod 22 to maintain its operational position. The end cap 36', due to its resilient nature, likewise functions to frictionally grip wall 26. Importantly, the wall gripping action at end cap 36' is enhanced materially by the fact that the upturned end portion 34 (see FIG. 3) in conjunction with the rigid body portion 32 and the fulcrumlike connection of the latter with the shower curtain rod, creates a triangular support system whereby a large component of the vertical load carried on the assembly, viz., the weight of rod 30 and the clothes hanging thereon, is resolved directly into or toward wall 26 at cap 36' rather than acting totally vertically or along the wall 26. Because of this geometrical arrangement, as the supported load increases, the forces holding cap 36' against wall 26 also increase.

Once erected, the assembly 20 will stay in place primarily due to its above-noted support system and will easily and directly handle articles of clothing 46, including hanger suspended clothing, without permitting them to gravitate along the rack assembly, as is the case with certain of the prior art devices.

With regard to the modified assembly of FIGS. 5 and 6, it will be noted that the V-shaped stop 138 thereof is operationally positioned so that the divergent arms 139, 139', straddle the shower curtain rod 22 with arm 139' snugged against the rod 22. Thus any force along linear portion 32, tending to move the same relative to the underlying curtain rod, acts to spread the arms 139, 139' and increase gripping engagement with member 30.

From the foregoing, it is believed that those skilled in the art will readily appreciate the unique features and advantages of the present invention over previous types of portable clothes drying racks. Further, it is to be understood that while the present invention has been described in relation to a particular preferred illustrative embodiment, as set forth in the accompanying drawings, the same nevertheless is susceptible to change, variation and substitution of equivalents without departure from the spirit and scope of this invention. It is therefore intended that the present invention be unrestricted by the foregoing description and drawings, except as may appear in the following appended claims.

The embodiments of the invention in which an exclusive property or privilege is claimed are defined as follows:

1. A lightweight, portable clothes drying rack adapted to be removably erected over a shower or bath tub enclosure to extend between a horizontal shower curtain rod and an opposing wall of the enclosure, comprising: a unitary elongated tubular member formed with a linear body portion having one end thereof bent angularly outward to provide an upturned end portion extending at substantially 45 degrees relative to said body portion, said upturned end portion being operationally engagable with said opposing wall at an elevation above said body portion and the latter overlying said curtain rod and extending horizontally toward said wall in operation; a protective cap member mounted over the open end of said upturned end portion for frictionally engaging said wall, and a unitary resiliently flexible stop member mounted on said body portion; said stop member being substantially triangular in shape with a central opening for the passage of said body portion therethrough and of a size to produce relatively tight frictional engagement therewith while affording selective positioning of said stop member along said body portion whereby to accommodate variations in the shower curtain rod to opposing wall distance; and a depending lobe portion on said stop member for abuttingly engaging said curtain rod, the abutting engagement of said lobe portion serving to flex the stop member and resiliently deform said opening therein whereby to frictionally lock said stop member to said body portion and frictionally couple the latter to said curtain rod.

* * * * *